US007651098B2

(12) United States Patent
Cho

(10) Patent No.: US 7,651,098 B2
(45) Date of Patent: Jan. 26, 2010

(54) SCREEN NET

(76) Inventor: Kwang Han Cho, 10126 Reseda Blvd., #110, Northridge, CA (US) 91324

( * ) Notice: Subject to any disclaimer, the term of this patent is extended or adjusted under 35 U.S.C. 154(b) by 0 days.

(21) Appl. No.: 12/025,550

(22) Filed: Feb. 4, 2008

(65) Prior Publication Data

US 2009/0197707 A1 Aug. 6, 2009

(51) Int. Cl.
*A63B 63/00* (2006.01)

(52) U.S. Cl. ..... 273/400; 473/197; 273/396

(58) Field of Classification Search ..... 273/398–402, 273/395, 396; 473/476, 478, 434, 435, 454, 473/456, 197
See application file for complete search history.

(56) References Cited

U.S. PATENT DOCUMENTS 5,564,711 A * 10/1996 Scheie ..... 273/400
6,514,149 B2 * 2/2003 Yoon ..... 473/197
6,517,444 B1 * 2/2003 Yoon ..... 473/197
6,793,594 B1 * 9/2004 Grant ..... 473/476
6,991,567 B2 * 1/2006 Wong et al. ..... 473/478
7,021,630 B1 * 4/2006 Cho ..... 273/401
7,198,274 B2 * 4/2007 Cho ..... 273/400
2001/0006074 A1 * 7/2001 Zheng ..... 135/126
2006/0068943 A1 * 3/2006 Cho ..... 473/400

* cited by examiner

*Primary Examiner*—Mark S Graham
(74) *Attorney, Agent, or Firm*—John K. Park; Park Law Firm

(57) ABSTRACT

A screen net includes a front member with an opening, a base member, a catch member and a wall member. The base member is placed on the ground. The catch member is adapted to catch a ball that passes through the opening of the front member. The wall member is positioned above the opening of the front member. The wall member comprises a wall fabric member and a wall pole member. The wall fabric member comprises a sleeve through which the wall pole member passes. The wall fabric member is attached to the front member. The ends of the wall pole member are supported by the base member. The screen net further comprises straps that connect the front member and the base member. The straps are under tension provided by the elastic pole segments.

6 Claims, 4 Drawing Sheets

SCREEN NET

BACKGROUND OF THE INVENTION

This invention relates to a screen net. More specifically, the present invention relates to a screen net that is used to retrieve practice balls and capable of retrieving balls that are thrown out of target area.

Conventional screen nets typically provide an aperture, though which practice balls thrown by a player pass, and a net behind the aperture to catch the practice balls. A larger aperture is needed to catch mistakenly thrown balls more. However, such approach increases the size and cost of a screen net and reduces portability. Also, a simply larger aperture does not provide training effect for guiding a user for more accurate throw.

SUMMARY OF THE INVENTION

The present invention is contrived to overcome the conventional disadvantages. Accordingly, it is an object of the present invention to provide a screen net that is effective in catching mistakenly thrown balls.

Another object is to provide a stable and portable screen net.

To achieve these and other objects, the present invention provides a screen net that includes a front member, a base member, a catch member and a wall member. The front member forms a front closed loop and includes an opening that substantially occupies the front closed loop. The base member forms a base closed loop and is adapted to be placed on the ground. The front member is foldably attached to the base member. The catch member is adapted to catch a ball that passes through the opening of the front member. The wall member is positioned above the opening of the front member.

The wall member comprises a wall fabric member and a wall pole member. The wall fabric member comprises a sleeve through which the wall pole member passes. The wall fabric member is attached to the front member.

The ends of the wall pole member are supported by the base member.

The wall member is inclined forward from the front member.

The wall fabric member comprises a mesh net. The catch member comprises a mesh net.

The front member is substantially rectangular, and the wall member is semi-circular.

The wall pole member comprises a plurality of elastic pole segments.

The screen net further comprises one or more straps that connect the front member and the base member. The straps are under tension provided by the elastic pole segments.

The front member comprises fabric reinforcements on the corners of the front closed loop. The base member comprises fabric reinforcements on the corners of the base closed loop.

The front member and the base member are each coilable to overlapping loops to facilitate a pop-up assembly, coiled disassembly and carriage of the screen net.

The screen net further comprises one or more connecting bands that connect the front member and the base member, and one or more connecting pole members. The connecting bands are elastic and the connecting pole members provide tension to the connecting bands.

The advantages of the present invention are (1) the screen net is light and portable and yet can absorb substantial impact by a ball thrown by a user; (2) the screen net catches erroneously thrown balls; (3) the screen net provides correcting effect in throwing practice balls.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
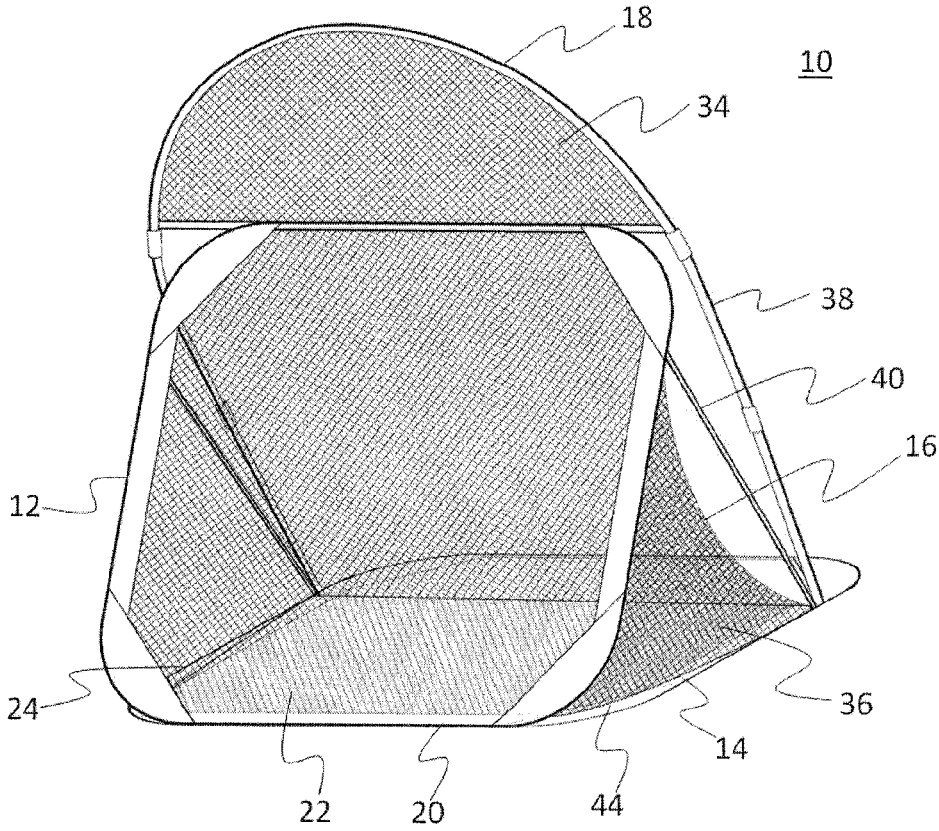
FIG. 1 is a perspective view illustrating a screen net according to the present invention.
Figure 5:
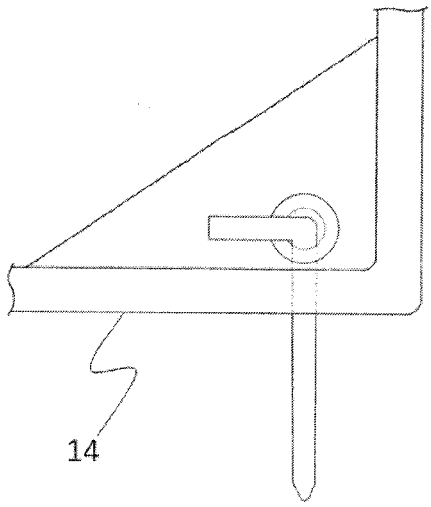
FIG. 5 is a partial perspective view showing how the screen net is fixed to the ground.

FIG. 1 shows a screen net 10 that includes a front member 12, a base member 14, a catch member 16 and a wall member 18. The front member 12 forms a front closed loop 20 and includes an opening 22 that substantially occupies the front closed loop 20. The base member 14 forms a base closed loop 24 and is adapted to be placed on the ground as shown in FIG. 5. The front member 12 is foldably attached to the base member 14. The catch member 16 is adapted to catch a ball that passes through the opening 22 of the front member 12. The wall member 18 is positioned above the opening 22 of the front member 12.

Figure 2:
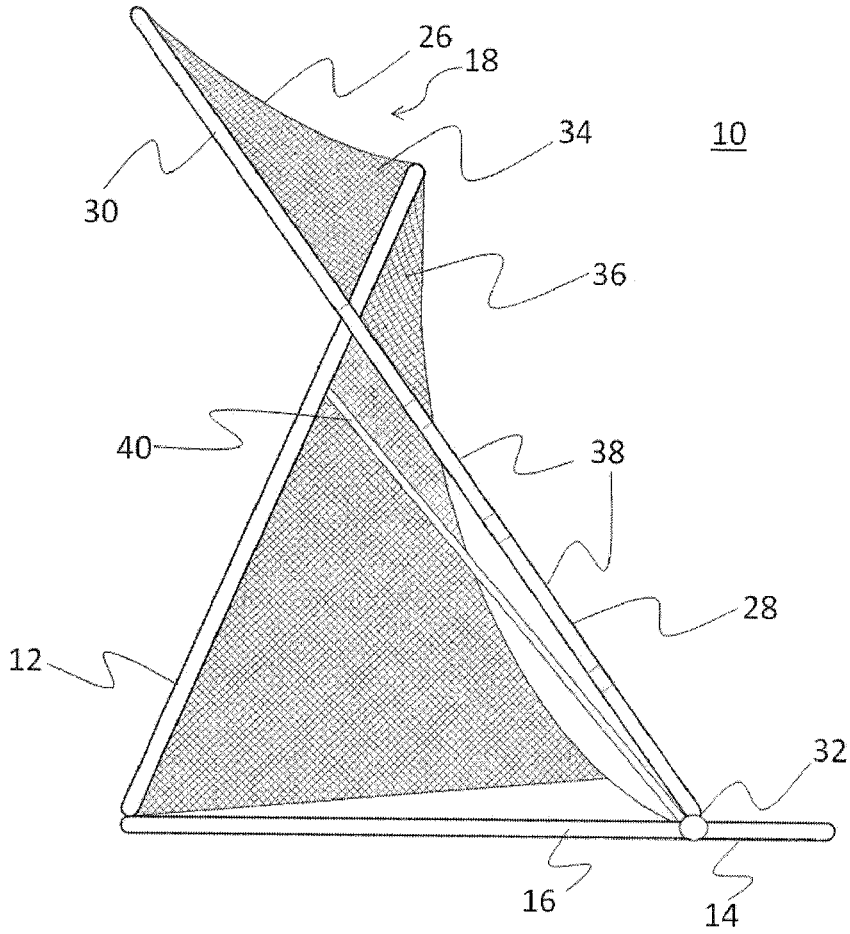
FIG. 2 is a side elevational view of the screen net.

As shown in FIG. 2, the wall member 18 comprises a wall fabric member 26 and a wall pole member 28. The wall fabric member 26 comprises a sleeve 30 through which the wall pole member 28 passes. The wall fabric member 26 is attached to the front member 12.

Figure 4:
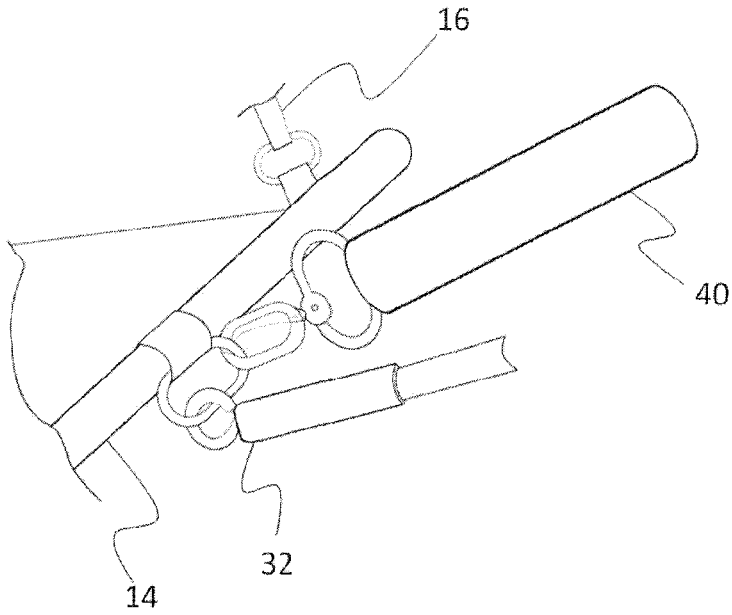
FIG. 4 is a partial perspective view showing how a strap and a wall pole member are attached to a base member.

The ends 32 of the wall pole member 28 are supported by the base member 14 as shown in FIG. 4.

As shown well in FIG. 2, the wall member 18 is inclined forward from the front member 14.

The wall fabric member 26 comprises a mesh net 34. The catch member 16 comprises a mesh net 36. The mesh net 36 of the catch member 16 is inclined upward toward the rear part of the screen net 10 to facilitate returning of a practice ball.

The front member 12 is substantially rectangular, and the wall member 18 is semi-circular.

The wall pole member 28 comprises a plurality of elastic pole segments 38.

The screen net 10 further comprises one or more straps 40 that connect the front member 12 and the base member 14. The straps 40 are under tension provided by the elastic pole segments 38.

The front member 12 comprises fabric reinforcements 42 on the corners of the front closed loop 20. The base member 14 comprises fabric reinforcements 44 on the corners of the base closed loop 24.

The front member 12 and the base member 14 are each coilable to overlapping loops to facilitate a pop-up assembly, coiled disassembly and carriage of the screen net 10.

The coilable front member 12 and the base member 14 together with multiple-segment wall pole member 28 provide portability of the screen net 10.

FIG. 2 shows how the shape and assembly relationship of the front member, base member, and wall member provide light yet sturdy structure.

Figure 6:
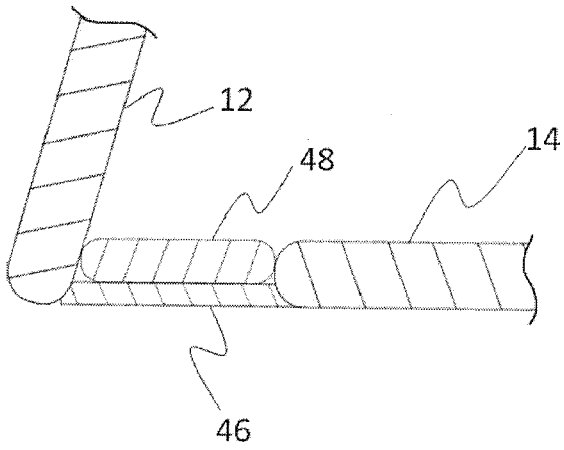
FIG. 6 is a partial cross-sectional view showing a connecting band and a connecting pole member.
Figure 3:
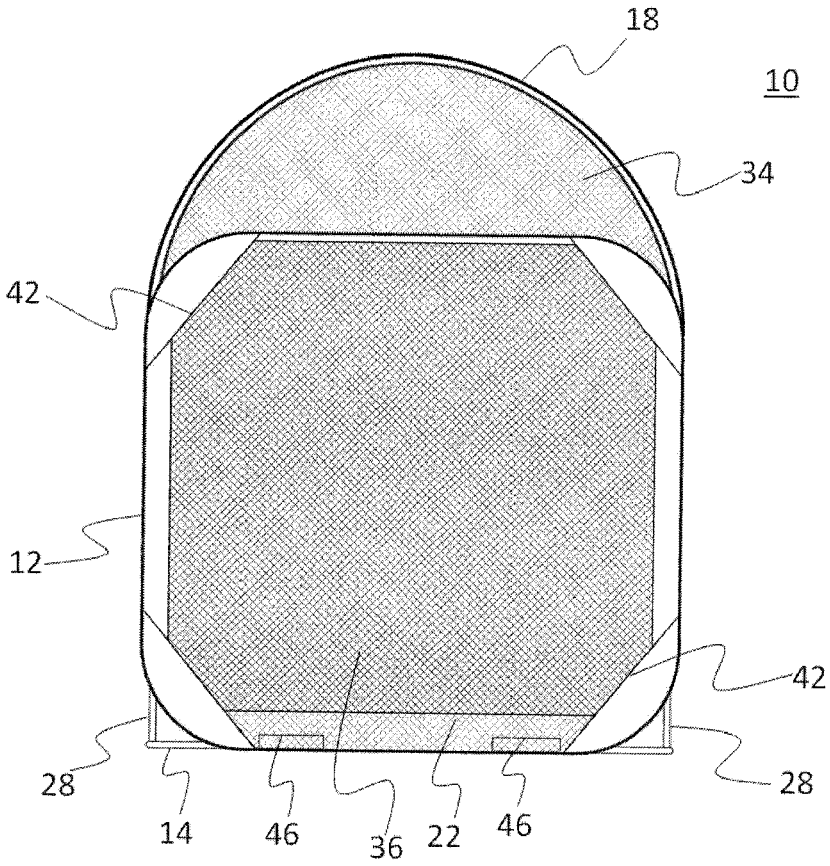
FIG. 3 is a front elevational view of the screen net.

FIG. 6 shows that the screen net 10 further comprises one or more connecting bands 46 that connect the front member 12 and the base member 14, and one or more connecting pole members 48. The connecting bands 46 are elastic and the connecting pole members 48 provide tension to the connecting bands 46. In this way, the front member 12 and the base member 14 need not to be sewn together. The connecting bands 46 may be attached to the front member 12 and the base member by sewing 14.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. A screen net comprising:

a) a front member forming a front closed loop, wherein the front member comprises an opening that substantially occupies the front closed loop;

b) a base member forming a base closed loop, wherein the base member is adapted to be placed on the ground, wherein the front member is foldably attached to the base member;

c) a catch member that is adapted to catch a ball that passes through the opening of the front member; and d) a wall member that is positioned above the opening of the front member, wherein the wall member comprises a wall fabric member and a wall pole member, wherein the wall fabric member comprises a sleeve through which the wall pole member passes, wherein the wall fabric member is attached to the front member, wherein the wall member is inclined forward from the front member, wherein the wall fabric member comprises a mesh net, wherein the catch member comprises a mesh net, wherein the mesh net of the catch member is inclined upward toward the rear end of the base member, wherein the wall pole member comprises a plurality of elastic pole segments, and further comprising one or more straps that connect the front member and the base member, wherein the straps are under tension provided by the elastic pole segments.

2. The screen net of claim 1, wherein the front member comprises fabric reinforcements on the corners of the front closed loop, wherein the base member comprises fabric reinforcements on the corners of the base closed loop.

3. The screen net of claim 2, wherein the front member and the base member are each coilable to overlapping loops to facilitate a pop-up assembly, coiled disassembly and carriage of the screen net.

4. The screen net of claim 2, further comprising one or more connecting bands that connect the front member and the base member, and one or more connecting pole members, wherein the connecting bands are elastic, wherein the connecting pole members provide tension to the connecting bands.

5. The screen net of claim 1, wherein the ends of the wall pole member are supported by the base member.

6. The screen net of claim 1, wherein the front member is substantially rectangular, wherein the wall member is semicircular.

* * * * *